US006485540B1

(12) United States Patent
Kosco

(10) Patent No.: US 6,485,540 B1
(45) **Date of Patent: *Nov. 26, 2002**

(54) METHOD FOR PRODUCING POWDER METAL MATERIALS

(75) Inventor: John C. Kosco, St. Marys, PA (US)

(73) Assignee: Keystone Investment Corporation, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/634,796

(22) Filed: Aug. 9, 2000

(51) Int. Cl.[7] ..... C22C 33/02; B22F 3/24
(52) U.S. Cl. ..... 75/29; 419/29
(58) Field of Search ..... 419/28, 29; 75/246

(56) References Cited

U.S. PATENT DOCUMENTS

| | | | | |
|---|---|---|---|---|
| 3,838,981 A | | 10/1974 | Foley et al. | |
| 4,050,932 A | | 9/1977 | Lemmer | |
| 4,069,044 A | | 1/1978 | Mocarski et al. | |
| 4,266,974 A | * | 5/1981 | Nitta et al. | 75/251 |
| 4,485,770 A | | 12/1984 | Saka et al. | |
| 4,508,567 A | * | 4/1985 | Mizuno et al. | 75/231 |
| 4,954,171 A | * | 9/1990 | Takajo et al. | 75/246 |
| 5,049,183 A | | 9/1991 | Saka et al. | |
| 5,080,712 A | | 1/1992 | James et al. | |
| 5,221,321 A | | 6/1993 | Lim | |
| 5,290,508 A | | 3/1994 | Kobayashi et al. | |
| 5,453,242 A | | 9/1995 | Knoess | |
| 5,476,632 A | | 12/1995 | Shivanath et al. | |
| 5,512,236 A | | 4/1996 | Jones et al. | |
| 5,516,483 A | | 5/1996 | Shivanath et al. | |
| 5,540,883 A | | 7/1996 | Jones et al. | |
| 5,613,180 A | | 3/1997 | Kosco | |
| 5,656,787 A | | 8/1997 | Shivanath et al. | |
| 5,682,588 A | | 10/1997 | Tsutsui et al. | |
| 5,754,937 A | | 5/1998 | Jones et al. | |
| 5,815,789 A | | 9/1998 | Akpan | |
| 5,834,640 A | | 11/1998 | Shivanath et al. | |
| 5,876,481 A | | 3/1999 | Chagnon et al. | |
| 5,997,805 A | | 12/1999 | Lawcock et al. | |
| 6,019,937 A | | 2/2000 | Shivanath et al. | |
| 6,139,598 A | * | 10/2000 | Narasimhan et al. | 75/246 |

* cited by examiner

*Primary Examiner*—Daniel J. Jenkins
(74) *Attorney, Agent, or Firm*—Kirkpatrick & Lockhart LLP

(57) ABSTRACT

A method of producing a powder metal material includes providing a metallurgical powder including at least one low alloy steel powder and 0.3 up to 1.0 weight percent carbon. At least portions of the powder are molded to provide compacts, and the compacts are then sintered at 1800° F. to 2400° F. The sintered compacts are hot formed and are subsequently heated to 1000° F. to 2300° F. and held at temperature for a predetermined time period. Material produced by the method may have tensile strength greater than 100 ksi, yield strength greater than 80 ksi, Rockwell C hardness of at least 20, and elongation greater than 2%, properties that are similar to ductile cast iron. Accordingly, parts produced by the method may be used in applications in which ductile cast iron parts are conventional. Such applications include, for example, parts for automotive engines and transmissions.

44 Claims, 2 Drawing Sheets

METHOD FOR PRODUCING POWDER METAL MATERIALS

CROSS REFERENCE TO RELATED APPLICATIONS

Not applicable.

STATEMENT REGARDING FEDERALLY SPONSORED RESEARCH OR DEVELOPMENT

Not applicable.

TECHNICAL FIELD AND INDUSTRIAL APPLICABILITY OF THE INVENTION

The present invention is directed to methods of producing materials from metallurgical powders and the materials provided by those methods. More particularly, the present invention is directed to methods of producing materials from metallurgical powders wherein the materials exhibit tensile strength greater than 100 ksi, yield strength greater than 80 ksi, Rockwell C (RC) hardness of at least 20, and elongation greater than 2%. Wrought materials commonly referred to as "ductile cast iron" generally exhibit those properties and are commonly used in applications such as engine and transmission parts. Certain engine and transmission parts, such as ring gears and other transmission gears, require a combination of high tensile and yield strength to withstand the forces encountered in such applications, RC hardness of 20 or greater to provide suitable wear resistance with acceptable machinablity, and elongation greater than about 2% to ensure adequate resistance to impact loading. Powder metal materials may be prepared by methods within the present invention with ductile iron-like properties and may be used in certain applications as substitutes for conventional ductile cast iron parts. More particularly, materials may be prepared by methods within the present invention having tensile strength greater than 100 ksi, yield strength greater than 80 ksi, Rockwell C (RC) hardness of at least 20, and elongation greater than 2%

DESCRIPTION OF THE INVENTION BACKGROUND

Ductile cast iron, also known as nodular iron or spheroidal-graphite cast iron, is cast iron that includes graphite in the form of tiny spheres or nodules. Because of additives introduced into the molten iron before casting, the graphite grows as spheres rather than as the flakes characteristic of gray iron. Ductile cast iron is much stronger and has higher elongation than gray iron, and it may be considered a natural composite in which the spheroidal graphite imparts unique properties to the material. Typical properties of ductile cast iron include tensile strength greater than 100 ksi, yield strength greater than 80 ksi, RC hardness of about 20, and elongation greater than 2%.

The relatively high strength and toughness of ductile cast iron provide advantages over gray in many structural applications. Such applications include, for example, automotive engine and transmission parts. Ductile cast iron can be produced to X-ray standards because porosity typically stays in the thermal center of the material.

Production of parts from ductile cast iron has many attendant difficulties. Greater metallurgical and process control is required in producing parts of ductile cast iron than in producing parts of other cast irons. Repeated chemical, mechanical, and metallurgical testing is needed to ensure that the required quality is maintained and that specifications are met. Producing ductile cast iron also requires carefull selection of charge materials, which must be free of undesirable residual elements. For example, carbon, manganese, silicon, phosphorous, and sulfur must be held at specified levels. Levels of magnesium, cerium, and certain other elements also must be controlled in order to attain the desired generally spherical graphite shape and to prevent the deleterious effects resulting from the presence of elements such as antimony, lead, titanium, tellurium, bismuth, and zirconium. The latter elements interfere with the graphite nodulizing process, and they must be either eliminated or restricted to very low concentrations.

An inherent limitation of ductile cast iron is that parts are produced of the material by casting. The casting of parts having intricate shapes is difficult, and significant machining or other finishing operations typically are required to prepare ductile cast iron parts in final form. Thus, although ductile cast iron provides significant advantages, primarily in terms of strength and elongation, it is difficult and time-consuming to prepare parts from the material on a commercial scale.

Accordingly, the need exists for methods of advantageously producing material and parts on a commercial scale having properties similar to ductile cast iron. A need also exists for materials having properties similar to ductile cast iron and which are produced by methods other than the casting of molten materials.

BRIEF SUMMARY OF THE INVENTION

In order to address the above-described needs, the present invention provides a novel method for producing a material from metallurgical powder. The method may be adapted to provide materials having tensile strength greater than 100 ksi, yield strength greater than 80 ksi, Rockwell C (RC) hardness of at least 20, and elongation greater than 2%, properties typically exhibited by ductile cast iron. The method includes the step of providing a metallurgical powder that includes at least one low alloy steel powder and 0.3 up to 1.0, preferably 0.4 up to 0.65, weight percent carbon in elemental, alloyed, or another form. At least a portion of the metallurgical powder is molded under pressure to provide a compact, and the compact is sintered at a temperature in the range of 1800° F. to 2400° F. and below the melting temperature of the compact, preferably for 10–60 minutes, to bond together the powder particles and provide a sintered compact. The sintered compact is subsequently hot formed. The hot formed compact is heated to a temperature in the range of 1000° F. to 2300° F. and below the melting temperature of the compact to re-sinter the compact. The hot forming and the subsequent re-sintering steps may work in conjunction to provide the material with the ductile iron-like properties.

According to another aspect of the invention, the invention is directed to a method for providing a material from metallurgical powder wherein the method includes providing metallurgical powder that includes at least one low alloy steel powder and 0.4 up to 0.65 weight percent carbon in elemental, alloyed, or another form. A compact is formed by pressing at least a portion of the powder in a mold at 20 to 70 tsi. The compact is heated to a temperature greater than 1800° F. and less than the melting temperature of the metallurgical powder to bond the metallurgical powder and form a sintered compact. The sintered compact is further compressed in a heated die at 20 to 80 tsi while the compact is at a temperature of 1400° F. to 2000° F., and the compact may then be cooled. The compact is subsequently heated to a temperature of 1000° F. to 2300° F. and below the melting temperature of the compact. The compact is then cooled to ambient temperature.

Additional aspects of the present invention are directed to materials produced by a method of the invention and articles of manufacture composed of or including such materials. Materials of the present invention find broad application and, as an example, may be used to form automotive engine and transmission parts such as, for example, ring gears and other gears, pinions, rollers, slides, valves, output shaft hubs, and reaction hubs.

As used herein, "metallurgical powder" refers to a particulate material including one or a combination of several particulate metal-containing materials. Thus, a metallurgical powder as used herein may include constituents including, for example, pure iron powder, other pure metal powders, and/or iron alloy or other alloyed powders, and also may include additive powders such as graphite, lubricants, additives enhancing wear resistance, and other additives enhancing one or more properties of the final material. As used herein, "sintering" has the meaning generally ascribed to that term by those of ordinary skill in the art and generally refers to heating a material composed of powder particles at a temperature of at least 70% of and lower than the melting temperature of the material, typically in a protective atmosphere, for a time so as to bond the powder particles. In the case of iron-base powder metal parts, for example, sintering typically involves heating the parts at temperatures within the range of 1800–2400° F. for 10–60 minutes. "Re-sintering" conventionally refers to subjecting a powder metal part which has already been sintered to a second thermal cycle, typically, but not necessarily at for times and temperatures within the ranges of the earlier sinter. As used herein, a "low alloy steel powder" refers to particulate material composed predominantly of iron and including one or more alloying ingredient in individual amounts less than about 10% by weight of the particulate material Material may be produced by a method of the present invention having properties similar to ductieast iron, but without a number of the attendant difficulties of producing the cast material. Powder metal material provided by the method of the present invention may have, for example, high tensile strength (greater than 100 ksi), yield strength in excess of 80 ksi, RC hardness of at least 20, and elongation greater than 2%. Thus, material produced by a method of the present invention may be used in many applications formerly filled by conventional ductile cast iron material or by other materials having the foregoing properties. Powder metallurgy production techniques utilized in the present method obviate many of the difficulties encountered with casting techniques. Also, because the properties of material produced by a method of the present invention do not depend on the presence of spherical graphite generated during freezing from the melt, the close control of material chemistry is not so critical.

The reader will appreciate the foregoing details and advantages of the present invention, as well as others, upon consideration of the following detailed description of embodiments of the invention. The reader also may comprehend additional advantages and details of the present invention upon carrying out or using the invention.

BRIEF DESCRIPTION OF THE FIGURES

The features and advantages of the present invention may be better understood by reference to the accompanying figures in which.

DETAILED DESCRIPTION OF EMBODIMENTS OF THE INVENTION

Figure 1:
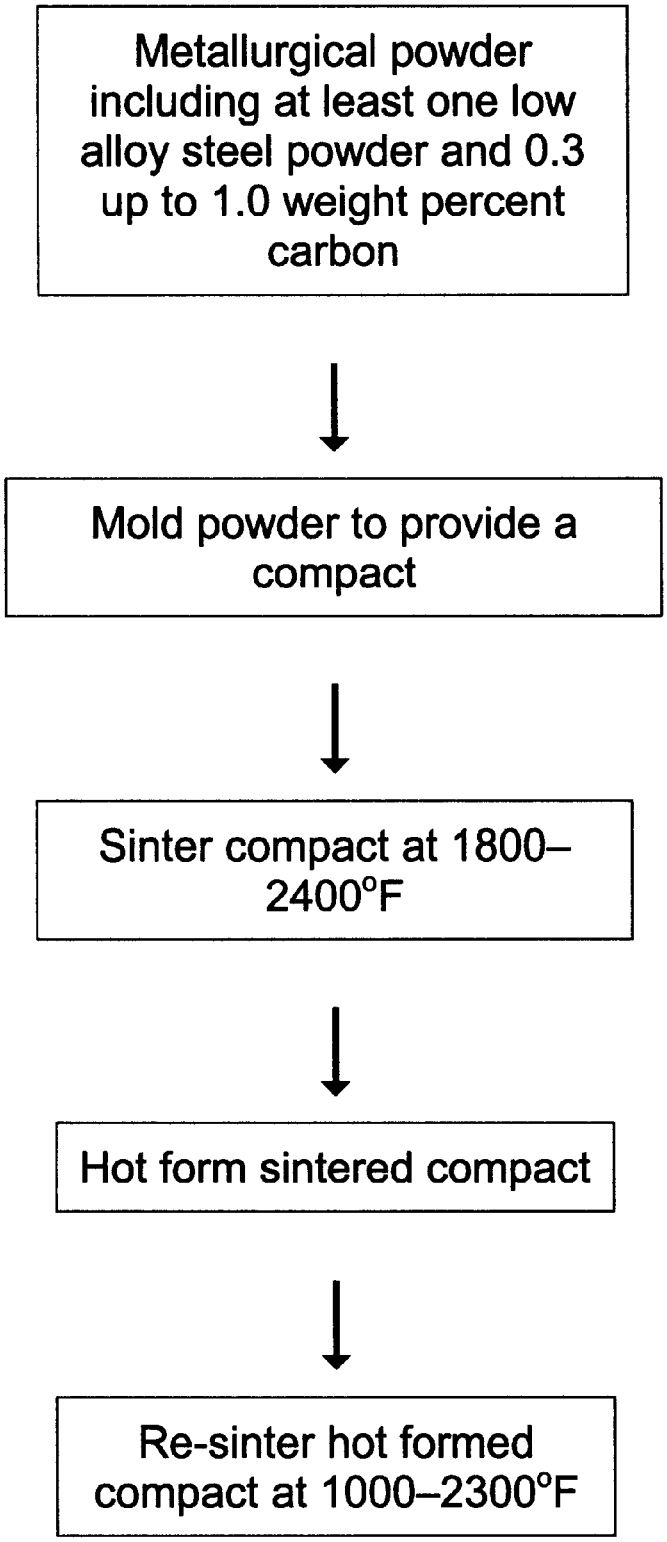
FIG. 1 is a schematic representation of one embodiment of the method of the present invention.

The present invention provides methods for producing powder metal materials that may have properties including tensile strength greater than 100 ksi, yield strength greater than 80 ksi, RC hardness of at least 20, and elongation greater than 2.0%. FIG. 1 illustrates an embodiment of the method of the present invention and includes the first step of providing a metallurgical powder that includes one or more low alloy steel powders and has 0.3 up to 1.0 weight percent carbon. The metallurgical powder preferably includes 0.4 up to 0.65 weight percent carbon. The metallurgical powder may be a single powder or a blend of two or more powders. The low alloy steel powder may be, for example, an iron-base powder including one or more of 0 up to 3 weight percent nickel, 0 up to 5 weight percent copper, 0 up to 0.5 weight percent manganese, 0 up to 4 weight percent molybdenum, and 0 up to 4 weight percent chromium. Specific examples of low alloy steel powders that may be included in the metallurgical powder include AISI 4600, 4400, and 4200 steel powders. Other forms of low alloy steel powder are readily available and will be known to those having ordinary skill. In one form of the method of FIG. 1 at least 50 weight percent of the metallurgical powder is a powder including not less than 90 weight percent iron. The metallurgical powder also may include, for example, 0.5 to 3.0 weight percent or more copper, which may be provided in the metallurgical powder in the form of a pure copper powder or in another form.

Without intending to limit the composition of the metallurgical powder in any way, the powder also may include other additives for the purpose of alloying or to otherwise enhance the properties of the final material. Such additional additives include, for example, one or more selected from 0 up to 2.5 weight percent nickel, 0 up to 3.5 weight percent molybdenum, tool steel powder, ferroalloy powder, additives enhancing the machinablity of the final material, and additives enhancing the wear resistance of the final material. Examples of possible tool steel powders that may be included in the metallurgical powder are M2, M3, M4, and T15 tool steel powders. Examples of possible ferroalloy powder additions include, for example, iron-chromium, iron-molybdenum, iron-boron, iron-manganese, and iron-vanadium powders. Additives that will enhance machinablity of the final material include, for example, manganese sulfide powder. Additives that will enhance wear resistance of the final material include, for example, metal carbide powders and metal nitride powders. The metallurgical powder also may include up to 5 weight percent graphite powder and, more preferably, includes 0.3 to 1.0 weight percent graphite powder. Conventional lubricants also may be included in the powder. Examples of possible lubricants include ethylene bis-stearamide, zinc or lithium stearate, and stearic acid. Other possible alloying additions and additives to the metallurgical powder will be readily apparent to those of ordinary skill in the powder metallurgy art.

In a second step of the method illustrated in FIG. 1, at least a portion of the metallurgical powder is placed into a die and molded under pressure to provide a compact of desired shape. Preferably the compact is formed under a pressure of 20–70 tsi, and more preferably 30–50 tsi. If the pressing pressure is less than about 30 tsi, the green strength of the compact may be insufficient to prevent the compact from fragmenting during handling. If the pressing pressure is greater than about 50 tsi, die life may be undesirably reduced. Those having ordinary skill in the art may determine an appropriate pressing pressure to form compacts from a particular metallurgical powder having suitable strength, while allowing an acceptable service life for dies used to form the compacts.

In a third step of the method illustrated in FIG. 1, the compact is sintered by heating the compact to a temperature below the melting temperature of the compact and within the range of 1800–2400° F., preferably 2050–2300° F., for a period of time-at-temperature sufficient to fuse and/or bond the powder particles within the compact. Typically, an iron-base sintered compact produced in the third step will exhibit a density of 6.6–7.1 g/cc. The sintered compact's mechanical properties will depend on the composition and content of the metallurgical powder used. Hardness will usually be in the RB 20–100 range, with usual tensile strength of25–100 ksi. Typical properties of an iron-base sintered compact are RB 50–90 and tensile strength of 50–85 ksi. A suitable sintering temperature and time-at-temperature may readily be determined for compacts composed of a particular metallurgical powder by persons of ordinary skill in the art. Sintering may be carried out in, for example, a batch sintering furnace or a belt furnace equipped with a moving belt that allows compacts to be fed into the furnace continuously. Preferably, sintering is carried out in a protective atmosphere to prevent oxides and other contaminants from forming in the heated compacts. Examples of possible protective atmospheres include a vacuum, hydrogen, argon or other noble gas, pure nitrogen gas, a mixture of nitrogen and hydrogen gases, endogas, exogas, or other inert gases. Other techniques for sintering the compacts will be apparent to those having ordinary skill in the powder metallurgy arts. As is known in the art, endothermic gas ("endogas") and exothermic gas ("exogas") are the gaseous products of the combustion of air and natural gas. The gas/air ratio determines the composition of the resulting gas. Endogas is more reducing than exogas. Typical constituents of endogas and exogas are nitrogen, hydrogen, carbon monoxide, carbon dioxide, methane, and water.

After sintering, the compacts may be cooled in the protective atmosphere or in air. Preferably, cooling occurs in the same protective atmosphere used during sintering, and a belt sintering furnace, for example, may be designed to include a cooling region within the protective atmosphere.

In a fourth step of the method illustrated in FIG. 1, the sintered compacts are hot formed by pressing the compacts in a heated die. The hot forming step increases the density of the compacts and also alters one more external or internal dimensions of the compact to more closely achieve the desired part shape. When hot formed, the compacts are at a temperature below their melting temperature, are preferably at about 1400° F. to about 2000° F., and are more preferably at about 1600° F. to about 1800° F. At compact temperatures below 1400° F., higher tonnages may be required to suitably density the compacts. Compact temperatures in excess of 2000° F. may cause carbon in any lubricant coating on the compacts to go into solid solution, reducing part lubrication and resulting in excessive die wear. The inventor has observed that compact temperatures in the 1600–1800° F. range minimize tonnages needed to obtain high part densities. Compacts previously cooled to room temperature after sintering may be reheated to such hot forming temperature. One method for reheating the sintered compacts includes coating the sintered compacts with a protective substance such as, for example, a graphite slurry or molybdenum disulfide, and then induction heating the compacts to 1400–2000° F. in an induction heating coil positioned adjacent to the hot forming die. The heated compacts are then positioned in the hot forming die and pressed.

The die of the hot forming press is heated to high temperature, such as, for example, about 400° F. to about 600° F., to enhance the densification achieved on pressing. Thermal shock problems have been associated with hot forming press die temperatures of less than 400° F., while die temperatures in excess of 600° F. typically provide little improvement in the hot formed part. Preferably, the pressing pressure used in hot forming is 20 to 80 tsi, but the pressure that is suitable will vary depending on the material involved and the increase in density that is desired. One having ordinary skill may determine suitable combinations of hot forming pressures, die temperatures, and compact temperatures without excessive experimentation. The inventor has determined that iron-base compacts pressed, sintered, and hot formed in the fashion generally shown in FIG. 1 typically have densities of 7.4 to 7.85 grams/cc, hardness of RC 30–45, and less than 1% elongation. Thus, the elongation properties of such compacts are deficient relative to those typically exhibited by ductile cast irons.

In a fifth step of the method illustrated in FIG. 1, the hot formed compacts are again heated to a high temperature below the compacts' melting temperature, and preferably are heated to a temperature in the range of about 1000° F. to 2300° F., and held at temperature for a predetermined time period. The temperature and time-at-temperature are selected so as to re-sinter the compacts by further reducing porosity in the compacts and/or to achieve properties similar to ductile cast iron. The density of at least a region of the compacts may be increased during the heating step. The heating step may be carried out in a protective atmosphere selected from, for example, the protective atmospheres that may be used for the initial sinter. A combination of nitrogen and hydrogen gases is preferred because it gives good protection from oxidation, allows easy control of final carbon content, and is relatively economical. The specific re-sinter temperature required to develop desired properties in a compact will depend upon the composition of the hot formed part. As a general rule, the higher the alloy content of iron-base parts, the higher the re-sinter temperature required to obtain properties similar to ductile cast iron, including tensile strength greater than 100 ksi, yield strength greater than 80 ksi, Rockwell C (RC) hardness of at least 20, and elongation greater than 2%. Compacts including copper, for example, are more prone to exhibit RC hardnesses above RC30 after hot forming, but by selection of appropriate re-sinter conditions, the compacts will develop the RC hardness and enhanced elongation properties of ductile cast iron material.

Subsequent to the heating step, the compacts are cooled to room temperature in ambient air or, preferably, in any protective atmosphere surrounding the compacts during the heating step. The cooling rate, in addition to the re-sinter temperature and time-at-temperature selected will depend upon the material composition, the properties of the sintered compact achieved through hot forming, and the properties desired on cooling after the re-sinter. Those of ordinary skill will, after having considered the present description of the invention, be able to determine the re-sinter and cooling parameters necessary to provide properties including tensile strength greater than 100 ksi, yield strength greater than 80 ksi, Rockwell C (RC) hardness of at least 20, and elongation greater than 2%.

It will be understood that other processing steps may be included intermediate the distinct steps of the embodiment of the invention illustrated in FIG. 1 or after the final step shown in that figure. For example, subsequent to the hot forming step and prior to the re-sinter step, compacts may be processed so as to alter their dimensions and/or increase their density within a region or throughout. As an example, the processing may be accomplished by one or more known mechanical working techniques such as sizing, burnishing, rolling, shot peening, or similar secondary operations to achieve final dimensions, improve surface finish, or enhance properties. A modification to the method illustrated in FIG. 1, for example, may include the step of sizing the hot formed compacts to adjust part dimensions, or rolling the hot formed compacts to enhance rolling contact fatigue properties. Generally, sizing pressures of 50–80 tsi or rolling forces of 4000–10,000 lbs/inch of contact may be used in that modified process. The worked parts are then heated as described above to provide parts with tensile strength greater than 100 ksi, yield strength greater than 80 ksi, Rockwell C (RC) hardness of at least 20, and elongation greater than 2%.

Figure 2:
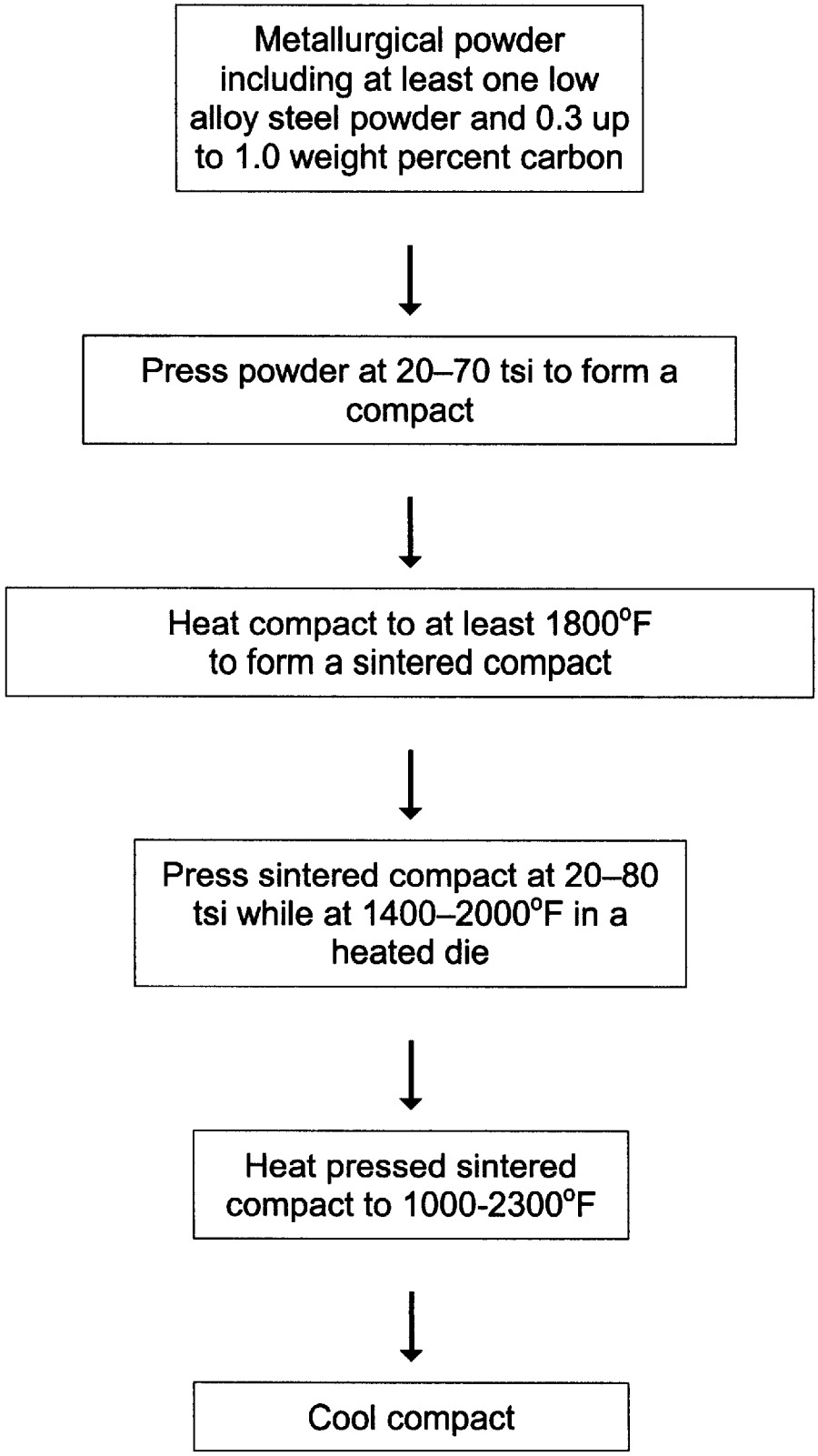
FIG. 2 is a schematic representation of another embodiment of the method of the present invention.

FIG. 2 illustrates a second possible embodiment of the method of the present invention which can provide parts having tensile strength greater than 100 ksi, yield strength greater than 80 ksi, Rockwell C (RC) hardness of at least 20, and elongation greater than 2%. In a first step, a metallurgical powder is provided including a low alloy steel powder and 0.3 up to 1.0 weight percent carbon. In a second step, portions of the powder are formed into compacts by pressing the powder in a mold at 20 to 70 tsi. In a third step, the compacts are heated to a temperature greater than 1800° F. and less than the melting temperature of the metallurgical powder to bond together the metallurgical powders and form a sintered compact. The sintered compacts, in a fourth step, are pressed at 20 to 80 tsi in a heated die while the compact is at a temperature of 1400° F. to 2000° F. In a fifth step, the pressed sintered compacts are heated to a temperature of 1000° F. to 2300° F. and below the melting temperature of the compact in a fashion to provide the compacts with desired properties. In a sixth step, the compacts are cooled to room temperature. Of course, other processing may occur intermediate or after the foregoing steps, as desired, using conventional powder metallurgy processing techniques.

Actual examples of the method and materials of the present invention follow:

EXAMPLE 1

A powder blend was provided by blending Hoeganaes grade A2000 AISI 4200 series steel powder, 0.6 weight percent Southwestern Graphite grade 1652 graphite powder (96 weight percent natural graphite and 4 weight percent ash), and 0.65 weight percent Atomized Acrawax lubricant (ethylene bis-stearamide). The nominal composition of the steel powder, in weight percentages, was 0.5% nickel, 0.6% molybdenum, 0.25% manganese, and balance iron. Portions of the powder blend were molded at 40 tsi into flat unmachined ASTM E8-M tensile test bar specimens having a thickness of 0.150 inch. The specimens were sintered at 2050° F. in an $N_2$-5% $H_2$ (by volume) atmosphere for about 25 minutes time-at-temperature (TAT). The specimens were cooled at about 40° F./minute on a belt in the sintering atmosphere to room temperature. The specimens were then coated with a graphite lubricant (DAG 137 from Acheson Colloids, Port Huron, Mich.), heated to about 1800° F., placed in a hot forming die heated to 600° F., and pressed in the die at 50 tsi. The heated hot forming die was basically the same shape as the molding die but slightly larger on the outside dimensions and smaller on the inside dimensions (by approximately 0.010–0.040 inches) than the sintered compact so that some flow of metal occurred during hot forming. After hot forming, the parts were cooled at about 20° F./minute to room temperature in a protective atmosphere of nitrogen gas. The parts were then shot cleaned to remove any carbon lubricant from their surfaces. The specimens were then re-sintered at 2050–2280° F. in a gaseous $N_2$-5% $H_2$ environment for about 30 minutes and cooled at about 40° F./minute to room temperature.

The average mechanical properties of specimens evaluated during the processing sequence described in this Example 1 and in the as-sintered, sintered+hot formed, and sintered+hot formed+re-sintered states are provided below. Properties exhibited by ductile cast iron material meeting ASTM specification A536–72 100–70–03 also are provided.

| Material | Density (g/cc) | Hardness | UTS (ksi) | YS (ksi) | % Elongation |
|---|---|---|---|---|---|
| As-Sintered | — | B92 | 100 | 86 | 2.3 |
| Sintered + Hot Formed | — | C40 | 144 | 144 | 0.8 |
| Sintered + Hot Formed + Re-sintered | 7.5 | C20 | 123 | 84 | 4.4 |
| Ductile Cast Iron | 7.6 | C20 | 100 | 80 | 3.0 |

The specimens produced in the run of Example 1, although somewhat less dense overall than typical ductile cast iron, exhibited comparable RC hardness. Moreover, material of the invention produced in Example 1 exhibited superior ultimate tensile strength and yield strength, as well as greatly enhanced elongation, relative to typical ductile cast iron material. Producing the material of the invention by powder metal techniques avoided difficulties inherent in the casting techniques conventionally used to produce ductile cast iron and the parts could be produced to net shape.

EXAMPLE 2

A powder blend was produced from Pyron grade PMA75 AISI 4400 series steel powder (nominally 0.85 weight percent molybdenum, 0.25 weight percent manganese, and balance iron), 0.6 weight percent Southwestern Graphite grade 1652 graphite powder, and 0.65 weight percent Atomized Acrawax ethylene bis-stearamide lubricant. Portions of the powder blend were molded at 40 tsi into ten (10) tensile specimens as in Example 1 above. The specimens were sintered at 2050° F. in an $N_2$-5% $H_2$ atmosphere for 25 minutes TAT, and then cooled to room temperature at about 40° F./minute. The specimens were coated with graphite lubricant, heated to approximately 1800° F., placed into a hot forming die heated to 600° F., and pressed at 50 tsi. The specimens were then re-sintered by heating the specimens at 1200° F. for 30 minutes TAT in a gaseous $N_2$-5% $H_2$ environment and cooled at about 40° F./minute to room temperature. The average mechanical properties of specimens of this example in the as-sintered, sintered+hot formed, and sintered+hot formed+re-sintered states are provided below along with typical properties exhibited by ductile cast iron material.

| Material | Density (g/cc) | Hardness Hardness | UTS (ksi) | YS (ksi) | % Elongation |
|---|---|---|---|---|---|
| As-Sintered | 7.0 | C16 | 120 | 77 | 1.9 |
| Sintered + Hot Formed | 7.6 | C47 | 140 | 120 | 0.7 |
| Sintered + Hot Formed + Re-sintered | 7.6 | C24 | 125 | 108 | 4.2 |
| Ductile Cast Iron | 7.6 | C20 | 100 | 80 | 3.0 |

EXAMPLE 3

A powder blend having the following composition was prepared: 80 weight percent Pyron grade PMA75 AISI type 4400 steel powder (nominally 0.75 weight percent molybdenum, 0.25 weight percent manganese, balance iron); 20 weight percent Kobelco grade MA500 steel powder (nominally iron with less than 1 weight percent impurities); 2.5 weight percent Pyron grade 26006 copper powder; 0.6 weight percent Southwestern Graphite grade 1652 graphite powder; and 0.65 weight percent Atomized Acrawax lubricant. Portions of the powder blend were molded at 40 tsi into ten dog bone-shaped tensile specimens as in Example 1 above. The molded specimens were sintered at 2080° F. in an $N_2$-5% $H_2$ atmosphere for 30 minutes TAT and then cooled at about 40° F./minute to room temperature. The specimens were coated with a graphite lubricant, heated in an induction coil to about 1800° F., placed in a hot forming die heated to 600° F., and pressed at 50 tsi. The hot formed specimens were cooled in a protective atmosphere at about 40° F./minute to room temperature. The specimens were then re-sintered by heating the specimens at 2080° F. for about 25 minutes in a $N_2$-5% $H_2$ atmosphere and then cooled to room temperature at about 40° F./minute.

The average mechanical properties of the cooled re-sintered specimens produced in this example and typical properties of ductile cast iron material are provided below.

| Material | Density (g/cc) | RC | UTS (ksi) | YS (ksi) | % Elongation |
|---|---|---|---|---|---|
| Sintered + Hot Formed + Re-Sintered | 7.41 | 22 | 134 | 95 | 4.2 |
| Ductile Cast Iron | 7.8 | 20 | 100 | 80 | 2.0% |

As in Examples 1 and 2, although the density of the powder metal material of the invention is less than typical ductile cast iron, the powder metal material significantly improved upon the typical mechanical properties of the cast material, while the powder metal production method avoided difficulties associated with casting ductile cast iron parts.

EXAMPLE 4

Several iron-base powder blends were prepared, and portions of the blends were pressed at 50 tsi into specimens as described in Example 1. The samples were sintered, cooled to room temperature at about 40° F./minute, and then hot formed as described in Examples 1–3 above. The hot formed samples were cooled to room temperature, and then were re-sintered by heating to temperatures within the range of 1000–2300° F., held at temperature for about 30 minutes, and cooled to room temperature at about 40° F./minute. Certain of the samples were subsequently sized at 60 tsi. Mechanical properties of the cooled samples were then evaluated. The composition of the powder blends, the specific processing parameters employed, and the mechanical properties of the cooled final samples are provided in Tables 1 and 2 below. It will be seen that the properties of the materials of the invention compare favorably with those of ductile cast iron material.

TABLE 1

| Powder Blend | Sintering Temp. (° F.) | Post-Hot Form Heating Temp. (° F.) | Sizing Pressure (tsi) | Density (g/cc) | RC Hardness | Tensile Strength (ksi) | Yield Strength (ksi) | Elong. (%) |
|---|---|---|---|---|---|---|---|---|
| A | 2050 | 2280 | | 7.54 | 24 | 144.1 | 112 | 4.50 |
| A | 2050 | 1300 | | 7.54 | 21 | 120.4 | 99.6 | 2.04 |
| B | 2050 | 1300 | 60 | 7.50 | 21.5 | 108.3 | 95.3 | 2.71 |
| A | 2050 | 1300 | | 7.55 | 29 | 129.2 | 103 | 2.69 |
| A | 2050 | 1300 | 60 | 7.54 | 30.5 | 146 | 129 | 2.71 |
| C | 2050 | 1300 | | 7.50 | 20 | 110 | 93.1 | 5.19 |
| C | 2050 | 1300 | 60 | 7.50 | 20.5 | 113.2 | 91.4 | 3.91 |
| D | 2050 | 1300 | 60 | 7.55 | 22 | 107.4 | 90.2 | 3.38 |
| C | 2050 | 1200 | | 7.50 | 24.5 | 133.8 | 112 | 3.34 |
| E | 2050 | 1200 | | 7.50 | 24.5 | 125.5 | 108 | 4.2 |
| E | 2050 | 1000 | | 7.50 | 27.5 | 134.2 | 121 | 2.86 |
| F | 2050 | 1000 | | 7.55 | 20.5 | 106.7 | 102 | 2.39 |
| A | 2080 | 2280 | | 7.49 | 21 | 129.9 | 87.4 | 5.74 |
| G | 2080 | 2080 | | 7.48 | 25.5 | 140.5 | 100 | 3.80 |
| G | 2080 | 2280 | | 7.48 | 25 | 144.1 | 105 | 4.09 |
| H | 2080 | 1300 | | 7.49 | 20 | 117.7 | 102 | 3.66 |
| H | 2080 | 2080 | | 7.41 | 22.5 | 134.7 | 95.2 | 4.27 |
| H | 2080 | 2280 | | 7.57 | 24 | 134.5 | 96 | 3.28 |
| I | 2080 | 1000 | | 7.50 | 23.5 | 117.9 | 101 | 3.13 |

TABLE 2

| Powder Blend | Composition (Parts by Weight) | Carbon Content (Wt. %) | Copper Content (Wt. %) |
|---|---|---|---|
| A | 100 parts AISI 4600 steel powder + 0.8 parts graphite | 0.70 | — |
| B | 100 parts AISI 4600 steel powder + 0.6 parts graphite | 0.49 | — |
| C | 100 parts AISI 4200 steel powder + 0.8 parts graphite | 0.70 | — |
| D | 100 parts AISI 4200 steel powder + 0.6 parts graphite | 0.60 | — |
| E | 100 parts AISI 4400 steel powder + 0.6 parts graphite | 0.60 | — |
| F | 100 parts iron powder + 0.6 parts graphite | 0.50 | — |
| G | 97.5 parts AISI 4400 steel powder + 2.5 parts copper powder + 0.6 parts graphite | 0.50 | 2.5 |
| H | 77.5 parts AISI 4400 steel powder + 20 parts iron powder + 2.5 parts copper powder + 0.6 parts graphite | 0.50 | 2.5 |
| I | 57.5 parts AISI 4400 steel powder + 40 parts iron powder + 2.5 parts copper powder + 0.6 parts graphite | 0.50 | 2.5 |

The material of the present invention may be used in applications in which ductile cast iron is conventionally used. For example, powder metal material produced by any of the methods of the invention described in Examples 1–4 above could be used to form parts conventionally formed of ductile cast iron and other parts that must have tensile strength greater than 100 ksi, yield strength greater than 80 ksi, Rockwell C (RC) hardness of at least 20, and elongation greater than 2%. Such parts include automotive engine and transmission parts such as ring gears and other gears, pinions, rollers, slides, valves, output shaft hubs, and reaction hubs. Such parts may be produced by providing dies of appropriate shape and by otherwise suitably adapting methods within the present invention to make the part or parts of interest. Of course, materials of the invention are not restricted to such uses and may be applied in any capacity requiring material properties achievable by the methods of the invention. Those of ordinary skill in the art having first considered the present description of the invention may readily adapt the invention to manufacture automotive and other parts on a commercial scale without undue experimentation. Accordingly, any further description of the invention is believed unnecessary to fully support the scope of the claims appended hereto.

Accordingly, the present invention addresses difficulties encountered in conventional wrought metallurgy methods for making material, such as ductile cast iron, which may be processed to have tensile strength greater than 100 ksi, yield strength greater than 80 ksi, Rockwell C hardness of at least 20, and elongation greater than 2%. It is to be understood that the present description illustrates aspects of the invention relevant to a clear understanding of the invention. Certain aspects of the invention that would be apparent to those of ordinary skill in the art and that, therefore, would not facilitate a better understanding of the invention, have not been presented in order to simplify the present description. Although the present invention has been described in connection with certain embodiments, those embodiments should not be considered as limiting the true scope of the present invention. Those of ordinary skill in the art will, upon considering the foregoing description, recognize that modifications and variations of the invention may be employed. The foregoing description and the following claims are intended to cover all such variations and modifications of the invention.

I claim:

1. A method of providing a material having tensile strength greater than 100 ksi, yield strength greater than 80 ksi, RC hardness of at least 20, and elongation greater than 2.0%, the method comprising:

providing a metallurgical powder including a low alloy steel powder and 0.3 up to 1.0 weight percent carbon;

forming a compact from at least a portion of the metallurgical powder by pressing at least a portion of the metallurgical powder in a mold at 20 to 70 tsi;

heating the compact to a temperature greater than 1800° F. and less than the melting temperature of the metallurgical powder to bond together the metallurgical powder and form a sintered compact;

pressing the sintered compact at 20 to 80 tsi in a heated die while the compact is at a temperature of 1400° F. to 2000° F.; and heating the pressed sintered compact to a temperature of 1000° F. to 2300° F. and below the melting temperature of the compact to re-sinter the compact.

2. A material produced by a method comprising:

providing a metallurgical powder comprising a low alloy steel powder, the metallurgical powder including 0.3 up to 1.0 weight percent carbon;

molding at least a portion of the metallurgical powder to provide a compact;

sintering the compact at 1800° F. to 2400° F. to provide a sintered compact;

hot forming the sintered compact to provide a hot formed compact; and heating the hot formed compact to 1000° F. to 23° F., the material having tensile strength greater than 100 ksi, yield strength greater than 80 ksi, RC hardness of at least 20, and elongation greater than 2.0%.

3. A material produced by a method comprising:

providing a metallurgical powder including a low alloy steel powder and 0.3 up to 1.0 weight percent carbon;

forming a compact from at least a portion of the metallurgical powder by pressing at least a portion of the metallurgical powder in a mold at 20 to 70 tsi;

heating the compact to a temperature greater than 1800° F. an d less than the melting temperature of the metallurgical powder to bond together the metallurgical powder and form a compact;

pressing the compact at 20 to 80 tsi in a heated die while the compact is at a temperature of 1400° F. to 2000° F.; and heating the compact to a temperature of 1000° F. to 2300° F. and below the melting temperature of the compact, and then cooling the compact, the material having tensile strength greater than 100 ksi, yield strength greater than 80 ksi, RC hardness of at least 20, and elongation greater than 2.0%.

4. An article of manufacture, the article including a material produced by a method comprising:

providing a metallurgical powder comprising a low alloy steel powder, the metallurgical powder including 0.3 up to 1.0 weight percent carbon;

molding at least a portion of the metallurgical powder to provide a compact;

sintering the compact at 1800° F. to 2400° F. to provide a sintered compact;

hot forming the sintered compact to provide a hot formed compact; and heating the hot formed compact to 1000° F. to 2300° F., the material having tensile strength greater than 100 ksi, yield strength greater than 80 ksi, RC hardness of at least 20, and elongation greater than 2.0%.

5. An article of manufacture, the article including a material produced by a method comprising:

providing a metallurgical powder including a low alloy steel powder and 0.3 up to 1.0 weight percent carbon;

forming a compact from at least a portion of the metallurgical powder by pressing at least a portion of the metallurgical powder in a mold at 20 to 70 tsi;

heating the compact to a temperature greater than 1800° F. and less than the melting temperature of the metallurgical powder to bond together the metallurgical powder and from a compact;

pressing the compact at 20 to 80 tsi in a heated die while the compact is at a temperature of 1400° F. to 2000° F.; and heating the compact to a temperature of 1000° F. to 2300° F. and below the melting temperature of the compact, and then cooling the compact, the material having tensile strength greater than 100 ksi, yield strength greater than 80 ksi, RC hardness of at least 20, and elongation greater than 2.0%.

6. The article of manufacture of any of claims 4 and 5, wherein the article is a transmission component.

7. A method of producing a material, the method comprising:

providing a metallurgical powder comprising a low alloy steel powder, the metallurgical powder including 0.3 up to 1.0 weight percent carbon;

molding at least a portion of the metallurgical powder to provide a compact;

sintering the compact at 1800° F. to 2400° F. provide a sintered compact;

hot forming the sintered compact to provide a hot formed compact; and heating the hot formed compact to 1000° F. to 2300° F.

8. The method of claim 7, wherein the material has tensile strength greater than 100 ksi, yield strength greater than 80 ksi, RC hardness of at least 20, and elongation greater than 2.0%.

9. The method of claim 7, wherein the low alloy steel powder comprises, by weight, iron, 0 up to 3% nickel, 0 up to 5% copper, 0 up to 0.5% manganese, 0 up to 4% molybdenum, and 0 up to 4% chromium.

10. The method of claim 9, wherein the low alloy steel powder is at least one powder selected from the group consisting of 4600 steel powder, 4400 steel powder, 4200 steel powder.

11. The method of claim 7, wherein at least 50 weight percent of the metallurgical powder is a powder including not less than 90 weight percent iron.

12. The method of claim 7, wherein the metallurgical powder comprises, by weight, at least 0.5% copper.

13. The method of claim 12, wherein at least a portion of the copper in the metallurgical powder is in the form of a copper powder.

14. The method of claim 7, wherein the metallurgical powder further comprises at least one additive selected from the group consisting of up to 2.5 weight percent nickel, up to 3.5 weight percent molybdenum, tool steel powder, ferroalloy powder, machinablity additive, and wear resistance additive.

15. The method of claim 7, wherein the metallurgical powder further comprises at least one tool steel powder selected from the group consisting of M2, M3, M4, and T15 tool steel powders.

16. The method of claim 7, wherein the metallurgical powder further comprises at least one ferroalloy powder selected from the group consisting of iron-chromium, iron-molybdenum, iron-boron, iron-manganese, and iron-vanadium ferroalloy powders.

17. The method of claim 7, wherein the metallurgical powder further comprises at least one additive enhancing wear resistance of the material, the additive selected from the group consisting of metal carbide powder and metal nitride powder.

18. The method of claim 7, wherein at least a portion of the carbon in the metallurgical powder is in the form of graphite powder.

19. The method of claim 7, wherein the metallurgical powder comprises 0.4 up to 0.65 weight percent.

20. The method of claim 7, wherein molding at least a portion of the metallurgical powder comprises molding at least a portion of the metallurgical powder at 30 to 50 tsi to provide a compact.

21. The method of claim 7, wherein molding at least a portion of the metallurgical powder comprises molding at least a portion of the metallurgical powder at 20 to 70 tsi to provide a compact.

22. The method of claim 7, wherein sintering the compact comprises sintering the compact at 2050 to 2300° F. to provide a sintered compact.

23. The method of claim 7, wherein hot forming the sinter compact comprises hot forming the sintered compact at 20 to 80 tsi to provide a hot formed compact.

24. The method of claim 7, wherein prior to hot forming the compact, the compact is coated with a lubricant.

25. The method of claim 24, wherein the lubricant is at least one lubricant selected from the group consisting of graphite slurry and molybdenum disulfide.

26. The method of claim 7, wherein hot forming the sintered compact comprises providing the sintered compact at a temperature of 1400° F. to 2000° F., subsequently placing the sintered compact into a heated die, and pressing the sintered compact within the die at 20 to 80 tsi.

27. The method of claim 26, wherein the heated die is at 400° F. to 600° F.

28. The method of claim 26, wherein hot forming the sintered compact comprises providing the sintered compact at a temperature of 1600° F. to 1800° F. and subsequently placing the sintered compact into the heated die.

29. The method of claim 27, wherein sintering the compact comprises heating the compact in an atmosphere selected from the group consisting of a vacuum, nitrogen gas, hydrogen gas, a gaseous mixture including nitrogen gas and hydrogen gas, endogas, exogas, and argon gas.

30. The method of claim 7, wherein the hot formed compact has a density of 7.4 to 7.85 grams/cc, hardness of RC 30–45, and less than 2% elongation.

31. The method of claim 7, wherein heating the hot formed compact comprises heating the hot formed compact at a temperature below the melting temperature of the hot formed compact.

32. The method of claim 7, wherein heating the hot formed compact comprises heating the hot formed compact in an atmosphere selected from the group consisting of a vacuum, nitrogen gas, hydrogen gas, a gaseous mixture including nitrogen gas and hydrogen gas, endogas, exogas, and argon gas.

33. The method of claim 7, wherein subsequent to heating the hot formed compact, the density of at least a region of the compact is increased.

34. The method of claim 33, wherein increasing the density of at least a region of the compact comprises at least one of sizing, burnishing, rolling, or shot peening at least a region of the compact.

35. The method of claim 34, wherein increasing the density of at least a region of the compact comprises at least one of sizing at least a region of the compact at 50 to 80 tsi and rolling at least a region of the compact at a force of 4000 to 10,000 lbs/inch of contact.

36. A method of making a powder metal material, the method comprising:

molding a compact from a particulate material comprising a low alloy steel powder and including 0.3 up to 1.0 weight percent carbon;

sintering the compact at a temperature in the range of 1800° F. to 2400° F.;

hot forming the compact to provide a hot formed compact; and heating the hot formed compact to a temperature in the range of 1000° F. to 2300° F.

37. The method of claim 36, wherein the powder metal material has tensile strength greater than 100 ksi, yield strength greater than 80 ksi, RC hardness of at least 20, and elongation greater than 2.0%.

38. The method of claim 36, wherein at least 50 weight percent of the particulate material is a powder including not less than 90 weight percent iron.

39. The method of claim 36, wherein the particulate material comprises, by weight, at least 0.5% copper.

40. The method of claim 36, wherein the particulate material further comprises at least one of up to 2.5 weight percent nickel, up to 3.5 weight percent molybdenum, tool steel powder, ferroalloy powder, machinablity additive, and wear resistance additive.

41. The method of claim 36, wherein the hot formed compact has a density of 7.4 to 7.85 grams/cc, hardness of RC 30–45, and less than 2% elongation.

42. The method of claim 36, wherein subsequent to heating the hot formed compact the density of at least a region of the hot formed compact is increased by at least one of sizing, burnishing, rolling, and shot peening the hot formed compact.

43. The method of claim 36, wherein the low alloy steel powder comprises, by weight, 0 up to 3% nickel, 0 up to 5% copper, 0 up to 0.5% manganese, 0 up to 4% molybdenum, and 0 up to 4% chromium.

44. A method of making a powder metal material having tensile strength greater than 100 ksi, yield strength greater than 80 ksi, RC hardness of at least 20, and elongation greater than 2.0%, the method comprising:

molding a compact from a particulate material comprising a low alloy steel powder and including 0.3 up to 1.0 weight percent carbon at a pressure in the range of 20 to 70 tsi;

sintering the compact to a temperature greater than 1800° F. and less than the melting temperature of the low alloy steel powder;

pressing the compact at a pressure in the range of 20 tsi to 80 tsi while at a temperature in the range of 1400° F. to 2000° F. to provide a pressed compact; and re-sintering the pressed sintered compact at a temperature in the range of 1000° F. to 2300° F. and below the melting temperature of the compact.

* * * * *

UNITED STATES PATENT AND TRADEMARK OFFICE

CERTIFICATE OF CORRECTION

PATENT NO. : 6,485,540 B1
DATED : November 26, 2002
INVENTOR(S) : John C. Kosco

It is certified that error appears in the above-identified patent and that said Letters Patent is hereby corrected as shown below:

Column 2,
Line 2, delete “carefull” and replace with -- careful --.

Column 3,
Line 40, delete “ductieast” and replace with -- ductile cast --.

Column 5,
Line 21, add a space between “of25-100”

Signed and Sealed this

Third Day of June, 2003

JAMES E. ROGAN
*Director of the United States Patent and Trademark Office*